United States Patent [19]

Percival

[11] 4,129,226

[45] Dec. 12, 1978

[54] HINGED CLOSURES FOR CONTAINERS

[75] Inventor: Stephen J. Percival, Mardstone, England

[73] Assignee: Johnsen & Jorgensen (Plastics) Ltd., London, England

[21] Appl. No.: 615,066

[22] Filed: Sep. 19, 1975

[30] Foreign Application Priority Data

Sep. 20, 1974 [GB] United Kingdom ..... 41159/74

[51] Int. Cl.[2] ..... B65D 41/60

[52] U.S. Cl. ..... 215/235; 215/256; 215/253

[58] Field of Search ..... 215/236, 256, 253, 235

[56] References Cited

U.S. PATENT DOCUMENTS

| | | | |
|---|---|---|---|
| 1,557,653 | 10/1925 | Carvalho | 215/256 |
| 2,772,802 | 12/1956 | Woydatt | 215/256 |
| 2,894,654 | 7/1959 | Lohrer | 215/235 |
| 3,109,547 | 11/1963 | Wood | 215/256 |
| 3,266,652 | 8/1966 | Lohrer | 215/235 |
| 3,438,529 | 4/1969 | Lohrer | 215/253 |
| 3,441,161 | 4/1969 | Van Baarn | 215/235 |
| 3,991,904 | 11/1976 | Davis | 215/256 |

*Primary Examiner*—Ro E. Hart

*Attorney, Agent, or Firm*—Schuyler, Birch, Swindler, McKie & Beckett

[57] ABSTRACT

A hinged closure has a cap part and an integral band adapted to be separated circumferentially from one another except for a narrow interconnecting hinge by removing a partial arcuate tear band between the cap part and the anchor band and then applying upward pressure upon the cap part so as to tear two remaining arcuate membranes which connect the tear band with the hinge.

1 Claim, 5 Drawing Figures

HINGED CLOSURES FOR CONTAINERS

FIELD OF THE INVENTION

This invention relates to hinged closures for bottles and the like hereinafter simply called containers.

BRIEF DESCRIPTION OF THE PRIOR ART

The hinged closures to which the invention relates comprise a cap part, a tear band, an anchor band and a hinge to connect the cap part to the anchor band. These hinged closures have in the past few years achieved a very considerable success commercially and our hinged closures known under the Registered Trade Mark JAYCAP and manufactured under British Patent No. 812,580 are to be found on many different containers including bottles of still soft drink such as orange squash.

So far it has not proved possible to use our JAYCAPS on containers of aerated drinks because the internal pressure has created practical problems among which we should mention:

(a) The pressure inside bottles of a beverage such as tonic water may be as much as 120 p.s.i. and this has proved to be sufficient to blow our normal JAYCAPS right off the bottle.

(b) In cases in which our JAYCAPS have held in position the pressure inside the bottle has caused a leakage so that the beverage has gone flat.

(c) When removing the tear band the cap part has been blown open with such force that an injury could be sustained by the person opening the bottle.

SUMMARY OF THE PRESENT INVENTION

We have therefore carried out a series of experiments with a view to designing a special hinged closure adapted for use primarily with a container the contents of which is aerated. According to the present invention a hinged closure for closing the mouth of a container comprises a cap part, an integral anchor band adapted to embrace the neck of the container or that part of the container wall adjacent the mouth of the container and means for separating the anchor band from the cap part circumferentially except over a narrow interconnecting zone which constitutes a hinge, wherein the means for separating the anchor band from the cap part includes an arcuate partial tear band and at least one arcuate area of weakness.

Each of the problems mentioned above has required special attention and a solution is based upon the provision of a hinged closure in accordance with the statement above and preferably having the additional following features:

(a) We make the closure sufficiently strong to stay in position even with substantial pressure building up inside. This may be done by thickening the material of which the closure is made, by providing a bead of substantial size inside the anchor, by making the closure of a stronger material than heretofore (e.g. a plastics composition made up of about 90% low density polyethylene and about 10% high density polyethylene and by dishing the top of the cap part of the closure so that pressure existed inside at least partially expands itself by pushing up the dished part.

(b) We provide the closure with extra sealing means which may be in the form of annular external lamellas on a plug part of the closure.

(c) We make the thickness of membranes joining the tear band to the cap part and to the anchor part and the arcuate area of weakness of a thickness between 0.008 and 0.022 inch. This thickness is within this range because if the membrane thickness is less than 0.008 inch there is a danger that the carbonated pressure will blow the cap open and if the membrance thickness is greater than 0.022 inch then it will be difficult to tear the membrane when opening.

(d) We thicken the area of weakness in two opposed places so that the portion of the cap part torn away will flex upwards until the thickened areas tear. The effect of this is that after the partial tear band is torn away the cap part flexes rather in the manner of the opening of a crown stopper and this permits the pressure to be released in a controlled manner.

BRIEF DESCRIPTION OF THE DRAWINGS

This invention will now be described with reference to the accompanying drawings, given by way of example and in which.

DESCRIPTION OF A PREFERRED EMBODIMENT

Figure 1:
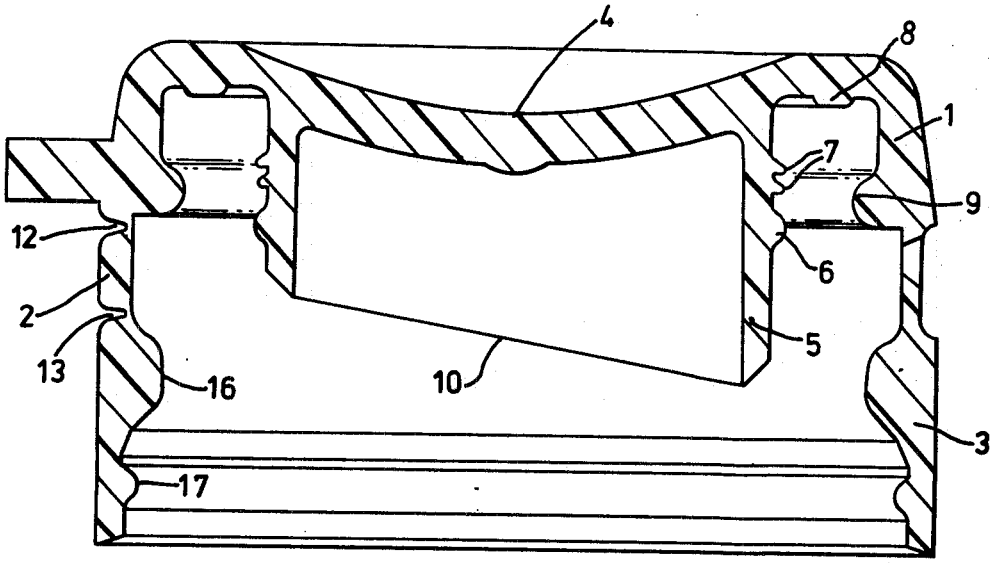
FIG. 1 is a vertical section of a closure embodying the invention

The closure comprises a cap part 1, a tear band 2 and an anchor band 3. The cap part 1 is centrally dished at 4 and has a depending plug 5 for insertion into the mouth of a container. The plug 5 has an external annular bead 6 and two annular lamellas 7 which seat against the inside of the mouth of a container. The cap part 1 also has further annular sealing beads 8 and 9 and the bottom of the plug is shaped to provide an oblique line 10 when inspected from the side.

The tear band 2 in the example illustrated extends for about 90° around the closure, that is 45° on each side of a thumb tab 11 and the tear band 2 is connected to the cap part 1 by a weakened membrane 12 and to the anchor band 3 by a weakened membrane 13. The weakened membrane 12 ends at each end 14 of the tear band 2 but the weakened membrane 13 extends on around the closure to the hinge 15 to form two arcuate weakened lines. The anchor band 3 has a large main internal bead 16 and a smaller auxiliary bead 17.

Figure 3:
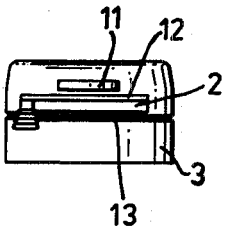
FIGS. 3 and 3*a* are side views of a closure from different directions.
Figure 3A:
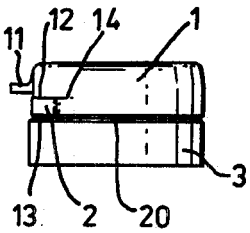
Figure 2:
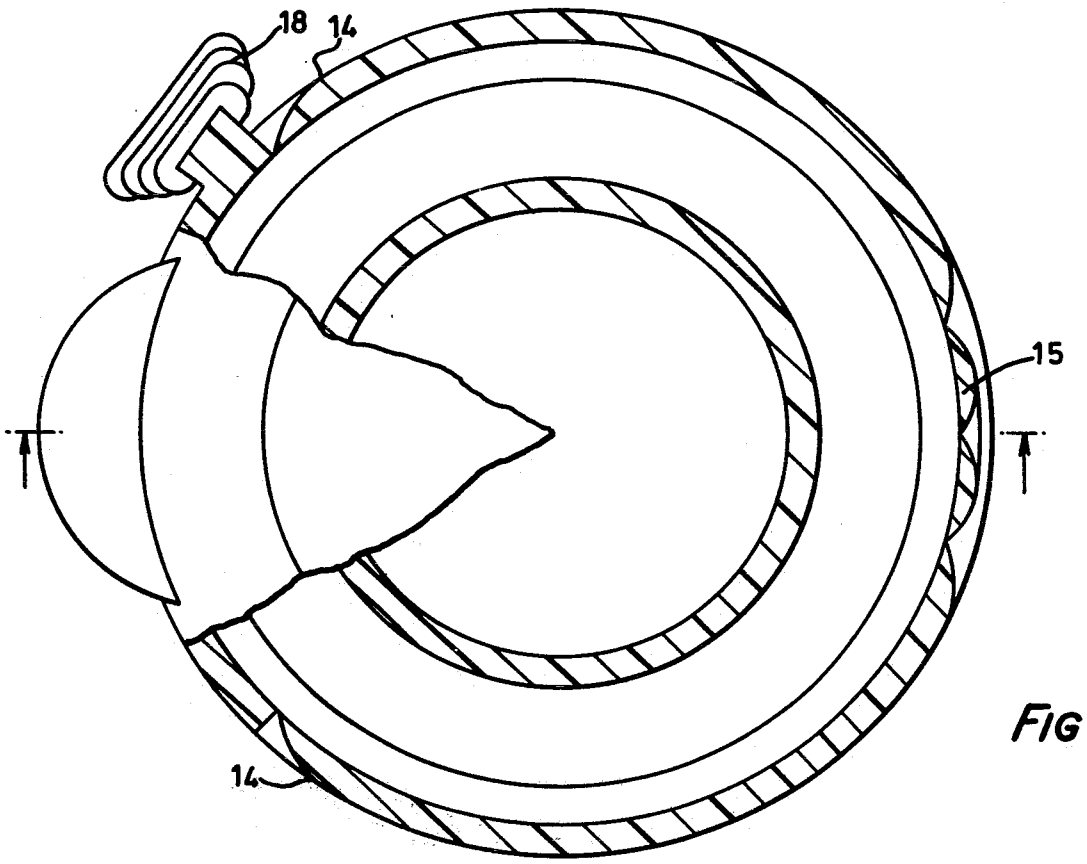
FIG. 2 is a sectional plan

At diametrically opposed positions on the weakened membrane 13 there is a thickened post 20 see FIG. 3*a* which resists tearing so that the left hand portion of the cap in FIG. 3*a* flexes upwards to release the pressure in a controlled manner until the thickened posts 20 tear.

In operation when it is desired to open a container which is closed by a closure as illustrated the tear band is torn away by seizing a finger grip 18 and pulling the band 2 around the closure in the usual way. When the band 2 has been torn to the end 14 upward pressure is exerted on the tab 11 to push the cap part 1 away from the anchor band 3 so that the rest of the weakened line 13 between the end 14 of the tear band 2 and the hinge 15 is broken and the cap part 1 pivots upwardly on the hinge 15.

Figure 4:
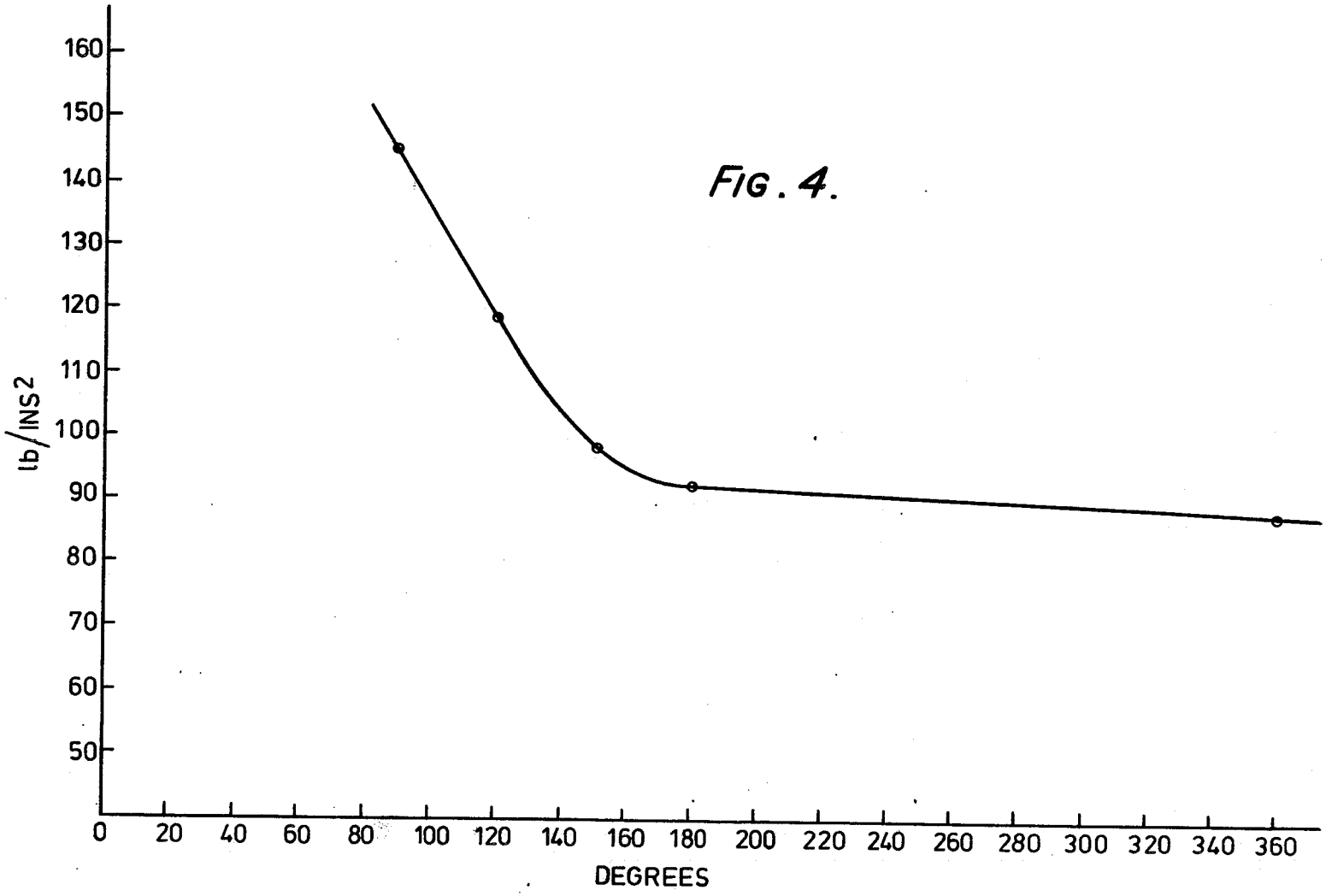
FIG. 4 is a graph.

It will be understood that for containers of liquid with a high aeration pressure the arc of the tear band will be small e.g. 90° while with lower pressures the arc of the tear band may be longer. Generally speaking tonic water with a pressure of about 120 p.s.i. has the highest pressure of any aerated soft drinks and to provide a hinged closure with a satisfactory safety margin for such a pressure we have found that the tear band should extend around the closure for not more than 45° on each side of the tab 11 i.e. 90° in all. This is clearly illustrated in the accompanying graph (FIG. 4) which plots lbs/ins$^2$ of pressure within a container against the arcuate degrees of the tear band and shows that to reduce the tear band from substantially 360° to 180° does not make much improvement after which a quick improvement sets in until with a 90° tear band blowing open does not occur on tearing away until a pressure of about 145 p.s.i. within a container is reached. The pressures plotted are averages obtained from 10 samples each at 90°, 120°, 150°, 180°, and a complete tear band.

What is claimed is:

1. A hinged closure for closing the mouth of a container comprising:

an annular anchor band attachable to the container around the mouth thereof, and a cap portion joined to said anchor band around the entire circumference thereof by means of a first weakened portion defining a first tear line extending around substantially the entire circumference, said cap having a thumb tab extending radially outwardly therefrom, a second weakened portion defining a second tear line spaced axially from said first tear line and extending partially around the circumference of said closure a predetermined distance on each side of said thumb tab, said first and second tear lines defining a tear band extending along the length of said second tear line, and means for grasping said tear band at one end thereof, whereby said closure is opened by pulling said tear band open and then removing said cap portion by pulling said thumb tab axially to cause said cap portion to be severed along said first tear line, a pair of thickened portions extending across said first tear line and located on opposite sides of said thumb tab, whereby said cap portion flexes about said thickened posts during the tearing away of said cap portion by the action of said thumb tab until said thickened portions tear to permit the remainder of said first tear line to be broken.

* * * * *